US009797649B2

(12) United States Patent
Li et al.

(10) Patent No.: US 9,797,649 B2
(45) Date of Patent: Oct. 24, 2017

(54) REFRIGERATOR

(75) Inventors: Lingyun Li, Anhui (CN); Gang Li, Anhui (CN); Dongxian Liu, Anhui (CN)

(73) Assignees: HEFEI MIDEA REFRIGERATOR CO., LTD., Heifi, Anhui (CN); HEFEI HUALING CO., LTD., Heifi, Anhui (CN)

( * ) Notice: Subject to any disclaimer, the term of this patent is extended or adjusted under 35 U.S.C. 154(b) by 555 days.

(21) Appl. No.: 13/510,851

(22) PCT Filed: Oct. 18, 2010

(86) PCT No.: PCT/CN2010/077845

§ 371 (c)(1),
(2), (4) Date: May 18, 2012

(87) PCT Pub. No.: WO2011/120294

PCT Pub. Date: Oct. 6, 2011

(65) Prior Publication Data

US 2012/0227433 A1 Sep. 13, 2012

(30) Foreign Application Priority Data

Apr. 2, 2010 (CN) ..... 2010 2 0154985 U
Apr. 2, 2010 (CN) ..... 2010 2 0155011 U
Jul. 16, 2010 (CN) ..... 2010 2 0261315 U

(51) Int. Cl.
*F25D 23/12* (2006.01)
*F25D 11/02* (2006.01)
*F25C 5/00* (2006.01)

(52) U.S. Cl.
CPC ..... *F25D 23/126* (2013.01); *F25C 5/005* (2013.01); *F25D 11/02* (2013.01)

(58) Field of Classification Search
CPC ..... F25C 5/005; F25C 2400/14; F25D 23/126
See application file for complete search history.

(56) References Cited

U.S. PATENT DOCUMENTS 3,012,417 A * 12/1961 Harle ..... F25C 1/225 239/510
3,600,905 A * 8/1971 Dymek et al. ..... 62/132
(Continued)

FOREIGN PATENT DOCUMENTS

CN 2128365 Y 3/1993
CN 1189601 A 8/1998
(Continued)

OTHER PUBLICATIONS

International Search Report dated Jan. 4, 2011 for corresponding International Application No. PCT/CN2010/077845, filed Oct. 18, 2010.

(Continued)

*Primary Examiner* — Judy Swann
*Assistant Examiner* — Zachary R Anderegg
(74) *Attorney, Agent, or Firm* — David D. Brush; Westman, Champlin & Koehler, P.A.

(57) ABSTRACT

A refrigerator includes a cabinet defining a refrigerating chamber and a freezing chamber, an ice making device and an ice making water supply device. A variable temperature drawer is disposed in lower part of the refrigerating chamber. The ice making water supply device includes a water tank disposed above the variable temperature drawer, a water pump connected with the water tank, and a water pipe connected with the water tank and the ice making device for introducing the water in the water tank into the ice making device. With the refrigerator according to embodiments, the water quality is ensured and the preservation effect is improved. Because the temperature of the variable temperature drawer is generally in the range of −3° C. to 8° C., the water in the water tank is not easy to be frozen, and can be supplied to the ice making device continuously.

15 Claims, 6 Drawing Sheets

(56) References Cited

U.S. PATENT DOCUMENTS

| | | | | |
|---|---|---|---|---|
| 3,722,586 | A * | 3/1973 | Baker | 166/85.2 |
| 8,413,459 | B2 * | 4/2013 | Kim | F25C 5/005 62/347 |
| 2005/0260104 | A1 * | 11/2005 | Culbert et al. | 422/121 |
| 2010/0229592 | A1 * | 9/2010 | Lim et al. | 62/389 |

FOREIGN PATENT DOCUMENTS

| | | | | |
|---|---|---|---|---|
| CN | 1282863 | A | | 2/2001 |
| JP | 2001041625 | A | * | 2/2001 |
| JP | 2006170545 | A | | 6/2006 |
| JP | 2006300437 | A | | 11/2006 |
| JP | 2009257728 | A | | 5/2009 |

OTHER PUBLICATIONS

English translation of the International Written Opinion dated Jan. 4, 2011 for corresponding International Application No. PCT/CN2010/077845, filed Oct. 18, 2010.

* cited by examiner

REFRIGERATOR

CROSS-REFERENCE TO RELATED APPLICATIONS

This U.S. application claims priority under 35 U.S.C 371 to, and is a U.S. National Phase application of, International Patent Application No. PCT/CN2010/077845, filed Oct. 18, 2010, which published as WO 2011/120294 on Oct. 6, 2011, not in English, and claims the benefit of prior Chinese Application No. 201020154985.0 filed Apr. 2, 2010, No. 201020155011.4 filed Apr. 2, 2010, and No. 201020261315.9 filed Jul. 16, 2010. The entire contents of the before-mentioned patent applications are incorporated by reference as part of the disclosure of this U.S. application.

STATEMENT REGARDING FEDERALLY SPONSORED RESEARCH OR DEVELOPMENT

None.

THE NAMES OF PARTIES TO A JOINT RESEARCH AGREEMENT

None.

FIELD

The present disclosure generally relates to household appliance, more particularly, to a refrigerator.

BACKGROUND ART

Ice making devices of some conventional refrigerators such as French style refrigerator (side by side refrigerator), use an external water supply, in which an end of the water supplying pipe of the ice making device is fixed to a rear wall of the refrigerator and mounted with a water connector which is connected to an external water tank or a water source by a long pipe, the other end of the water supplying pipe of the ice making device is passed through the rear wall of the refrigerator and extended into a freezing chamber, so as to supply water to the ice making device. However, this water supplying manner may cause some disadvantages: the pipeline of the refrigerator is complicated, quality of the water can not guaranteed, and the preservation effect of the refrigerator may be disadvantageously affected by unsanitary potentials.

Other refrigerators such as Japanese style refrigerator (multi-door refrigerator) have internal water supplying device. The internal water supplying device includes a water tank disposed in the refrigerating chamber, and a water supplying pipe connected to the water tank for supplying water to an ice making device. The water supplying pipe is passed through a thermal insulation layer between the refrigerating chamber and freezing chamber and extended into the freezing chamber, so as to supply water to the ice making device. The internal water supplying device may provide a relatively-closed water supply path so that user is able to fill sanitary pure water or mineral water into the water tank, thus guaranteeing quality of the water. However, the water tank is disposed onto the thermal insulation layer, so that the water contained in the water tank is easily to freeze, which can dramatically affect efficiency of the freezing camber and the refrigerator.

Moreover, in order to improve the insulation effect of the thermal insulation layer, most conventional refrigerators have employed an insulation manner in which a foaming agent having better insulation effect is filled into the thermal insulation layer instead of filing foam. Whereas, if the water supplying pipe was directly installed within the thermal insulation layer, the foaming agent would be quickly filled the whole space within the thermal insulation layer during foaming process, which may cause a deformation of the water supplying pipe. The deformation of the water supplying pipe may cause a gap formed in a connection between the water supplying pipe and the refrigerator chamber or freezing chamber, and the gap may easily cause foaming agent leakage. Therefore, the water supplying device of the conventional refrigerator has problems of improper installation of the water supplying pipe and the foam leakage occurred during the refrigerator operation.

SUMMARY OF THE DISCLOSURE

The present disclosure seek to solve at least one of the problems existing in the prior art to at least some extent. Accordingly, an object of the present disclosure is to provide a refrigerator which may provide clean and salutary water for ice making device thereof and improve preservation effect thereof.

According to embodiments of the present disclosure, there is provided a refrigerator comprising: a cabinet defining a refrigerating chamber and a freezing chamber therein, in which a variable temperature drawer is disposed in a lower part of the refrigerating chamber; an ice making device disposed in the freezing chamber, and a water supply device configured to supply water to the ice making device and including: a water tank disposed above the variable temperature drawer; a water pump connected to the water tank; and a water pipe unit connected to the water tank and the ice making device respectively to delivery water from the water tank into the ice making device.

With the refrigerator according to embodiments of the present disclosure, because the water supply device is disposed above the variable temperature drawer, users may fill the water tank with clean potable water. Comparing to the water supply device of conventional refrigerator using the external water source or barreled water, the water for making ice can be guaranteed to be salutary and clean, so that the possible disadvantageous influence of the water on the food stored in the freezing chamber is avoided, and the preservation effect of the refrigerator is improved.

In additional, comparing to the conventional refrigerator in which the water tank is disposed on the thermal insulation layer, a temperature range of the variable temperature drawer is between about −3° C. and about 8° C., the water in the water tank is hardly frozen, so that the water can be continuously supplied to the ice making device, thus ensuring ice making function and freezing effect.

In some embodiments, the refrigerator further comprises first and second containers for storing fruit and/or vegetables disposed above the variable temperature drawer respectively.

In some embodiments, the first and second containers are disposed at two sides of the water tank in a transverse direction, respectively.

Alternatively, the first and second containers have the same shape and size and are symmetrical about the water tank.

Therefore, for the French style refrigerator, when one of the first and second containers is needed to pull out, only one door corresponding to the one container is needed to open, so that the convenience is improved.

In another embodiment of the present disclosure, the first container is a parallelepiped box, a recessed groove is formed at a side of a bottom of the first container and the water tank is embedded in the recessed groove.

Alternatively, the first and second containers are symmetrical about a longitudinal center line of the refrigerating chamber.

In some embodiments, the water pump is disposed at a rear side of the water tank and detachably connected to the water tank, so that it is convenient for renewing the water in the water tank or cleaning the water tank by separating the water tank and the water pump. Moreover, when the water tank is not needed, the water tank can be removed and substituted by a sealed box, storing box or other storing container which has the same shape and size with the water tank, so that the storing space of the refrigerating chamber may be fully utilized.

According to an embodiment of the present disclosure, the water tank comprising: a tank body; a cover covering a top opening of the tank body; and a suction pipe defining a first end extending into a bottom of the tank body and a second end; in which the water pump has an inlet connected to the second end of the suction pipe and an outlet.

According to an embodiment of the present disclosure, the water pipe unit comprising: a funnel defining a first end disposed below the inlet for receiving water from the inlet and a second end; a connecting pipe defining a first end connected to the second end of the funnel and a second end; and an injection pipe defining a first end connected to the second end of the connecting pipe and a second end extended into the ice making device.

Alternatively, the refrigerator according to embodiments of the present disclosure further comprises a fixing unit disposed in a thermal insulation layer between the refrigerating chamber and the freezing chamber and configured to fix the injection pipe within the thermal insulation layer.

The injection pipe further comprising a first connecting section and a second connecting section; and the fixing unit comprises: a first fixing member fixing the first connecting section of the injection pipe to a bottom of the thermal insulation layer; and a second fixing member supporting the second connecting section of the injection pipe between the bottom and a top of the thermal insulation layer.

Alternatively, the first fixing member comprises a fixing end fixed to the bottom of the thermal insulation layer and having a connection hole in which the first connecting section of the injection pipe is fitted.

The first fixing member further comprises: a supporting end corresponded to the fixing end in a longitudinal direction and spaced apart from the top of the thermal insulation layer by a space; and a supporting column connected between the fixing end and the supporting end.

The supporting column is formed as a semi-tubular member having a predetermined wall thickness so as to be adapted to the first connecting section of the injection pipe.

Further alternatively, the first fixing member is integrally formed.

The fixing end has a flange fixed to the bottom of the thermal insulation layer.

Alternatively, the flange is fixed to the bottom of the thermal insulation layer using a double-sided adhesive sponge.

A recess is formed in a top of the second fixing member, the second connecting section of the injection pipe is received and supported in the recess; in which the second connecting section is formed with a boss secured to a lower surface of the top of the thermal insulation layer.

Alternatively, the second fixing member is made by foam.

For instance, the boss is secured to the top of the thermal insulation layer using a double-sided adhesive sponge.

With the refrigerator according to embodiments of the present disclosure, in the foaming process, the injection pipe is not easy to deform. In additional, the engagement between the injection pipe and the thermal insulation layer is not easy to loose, so as to avoid foam leaking, thus improving the of installation quality of the injection pipe and the structure reliability of water supply device.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference the accompanying drawings, in which.

DETAILED DESCRIPTION OF EMBODIMENTS OF THE DISCLOSURE

Figure 1:
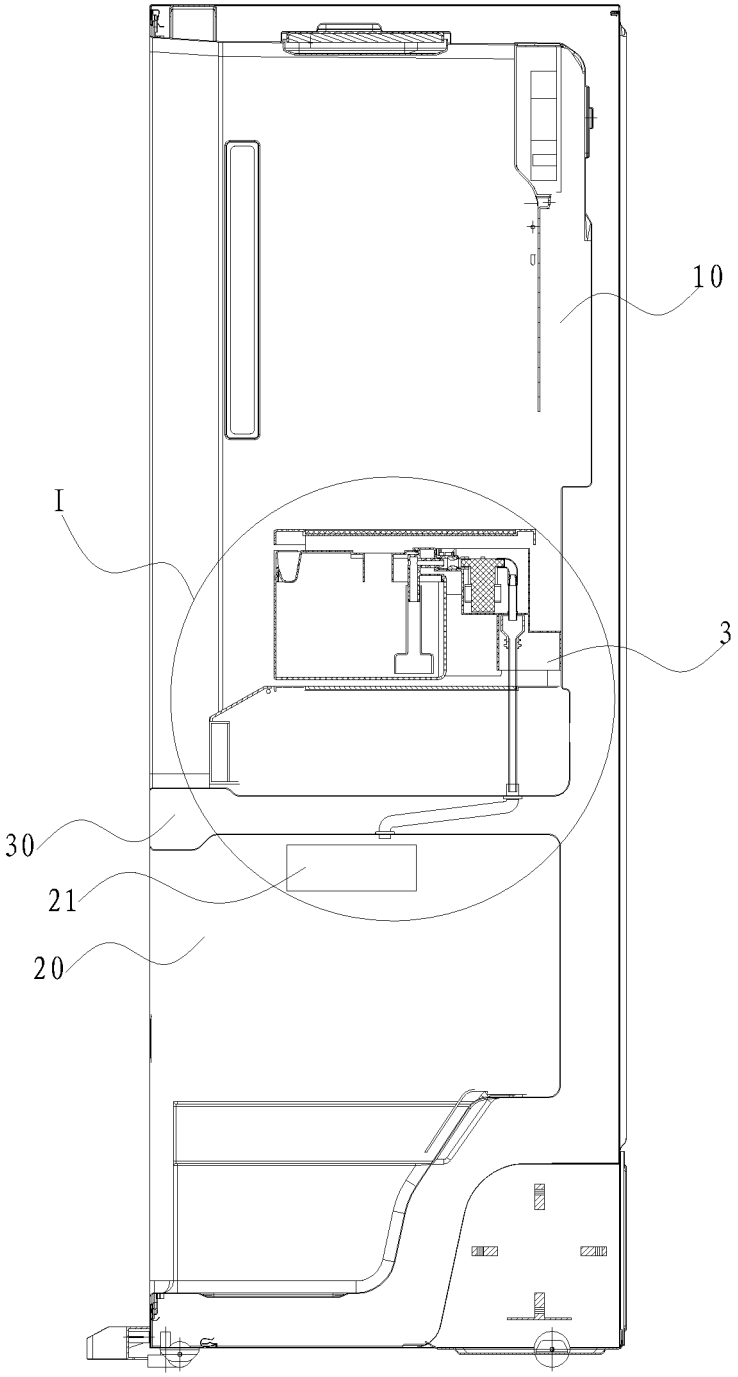
FIG. 1 is a schematic view of the refrigerator according to an embodiment of the present disclosure.

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

In the specification, Unless specified or limited otherwise, relative terms such as "inner", "outer", "lower", "upper", "above", "below", "up", "top", and "bottom" as well as derivative thereof should be construed to refer to the orientation as then described or as shown in the drawings under discussion. These relative terms are for convenience of description and do not require that the present disclosure be constructed or operated in a particular orientation.

The refrigerator according to embodiments of the present disclosure will be described below with reference of FIG. 1 to FIG. 7.

As shown in FIG. 1, a refrigerator according to an embodiment of the present disclosure comprises a cabinet, an ice making device 21 and a water supply device 3. The cabinet defines a refrigerating chamber 10 and a freezing chamber 20 therein, and the freezing chamber 20 is located below the refrigerating chamber 10. The ice making device 21 can makes ice automatically and is disposed in the freezing chamber 20. A variable temperature drawer 11 is disposed in a lower part of the refrigerating chamber 10 and the temperature of the variable temperature drawer 11 may be controlled within a low temperature range according to user's requirements, generally the low temperature range is between about −3° C. and about 8° C.

Figure 2:
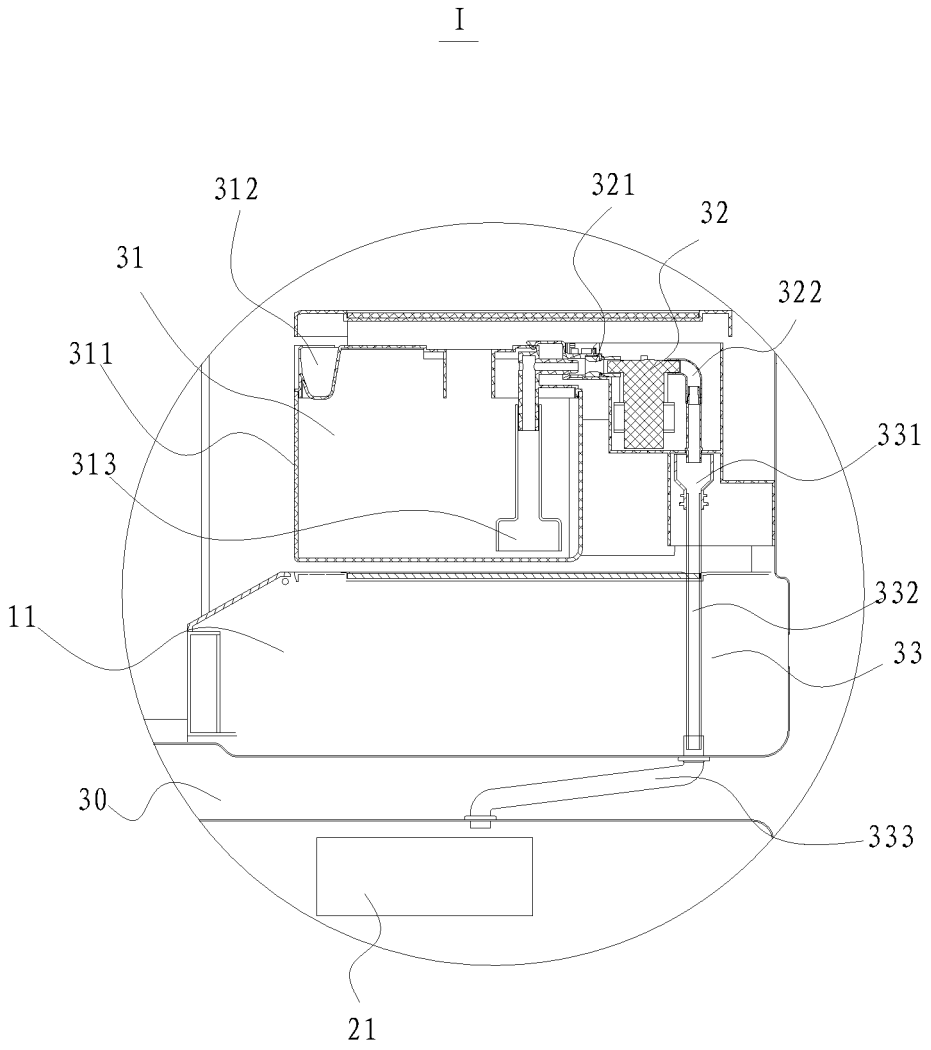
FIG. 2 is an enlarged schematic view of a portion indicated by Circle I in FIG. 1.

As shown in FIG. 2, a water supply device 3 includes a water tank 31, a water pump 32 and a water pipe unit 33. The water tank 31 is disposed above the variable temperature drawer 11, and the water pump 32 is connected to the water tank 31 so as to suck water out of the water tank 31. The water pipe unit 33 is connected to the water tank 31 and the ice making device 21 respectively, so as to delivery water from the water tank 31 into the ice making device 21, that is, to provide a water source for the ice making device 21. Preferably, the water pump 32 is detachably connected to the water tank 31, so that it is convenient for renewing the water in the water tank 31 or cleaning the water tank 31 by separating the water tank 31 and the water pump 32. Moreover, when the water tank 31 is not needed, the water tank 31 can be removed and substituted by a sealed box, storing box or other storing container which has the same shape and size with the water tank 31, so that the storing space of the refrigerating chamber 10 may be fully utilized.

In an embodiment of the present disclosure, the refrigerator further comprises a first container 12 and a second container 13. The first and second containers 12, 13 are disposed above the variable temperature drawer 11 respectively so as to facilitate the pulling out thereof. The first and second containers 12, 13 are suitable for storing fruits and/or vegetables, and shapes and sizes of the first and second containers 12, 13 can be determined according to requirements.

Figure 3:
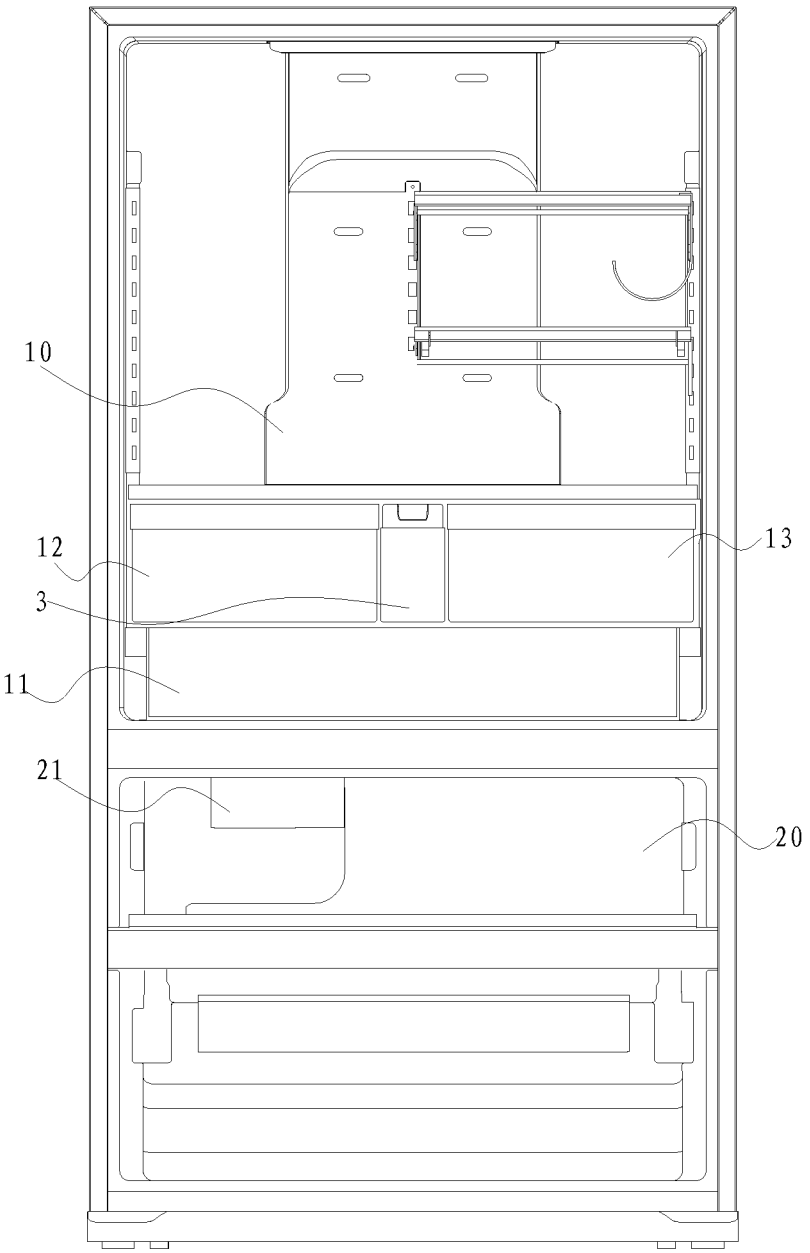
FIG. 3 is a schematic view of the refrigerator according to an embodiment of the present disclosure, showing first and second containers being disposed at two sides of a water tank in a transverse direction respectively.

In an example of the present disclosure, as shown in FIG. 3, the first and second containers 12, 13 are disposed at two sides of the water tank 31 in a transverse direction (the right and left direction in FIG. 3) respectively. Alternatively the first and second containers 12, 13 have the same shape and size and are symmetrical about the water tank 31. The above mentioned arrangement is especially suitable for the French style double-door refrigerators. For example, when one of the first container 12 and the second container 13 is needed to pull out, only one door corresponded to the one container is needed to open, so that the use of the refrigerator is flexible and convenient.

Figure 4:
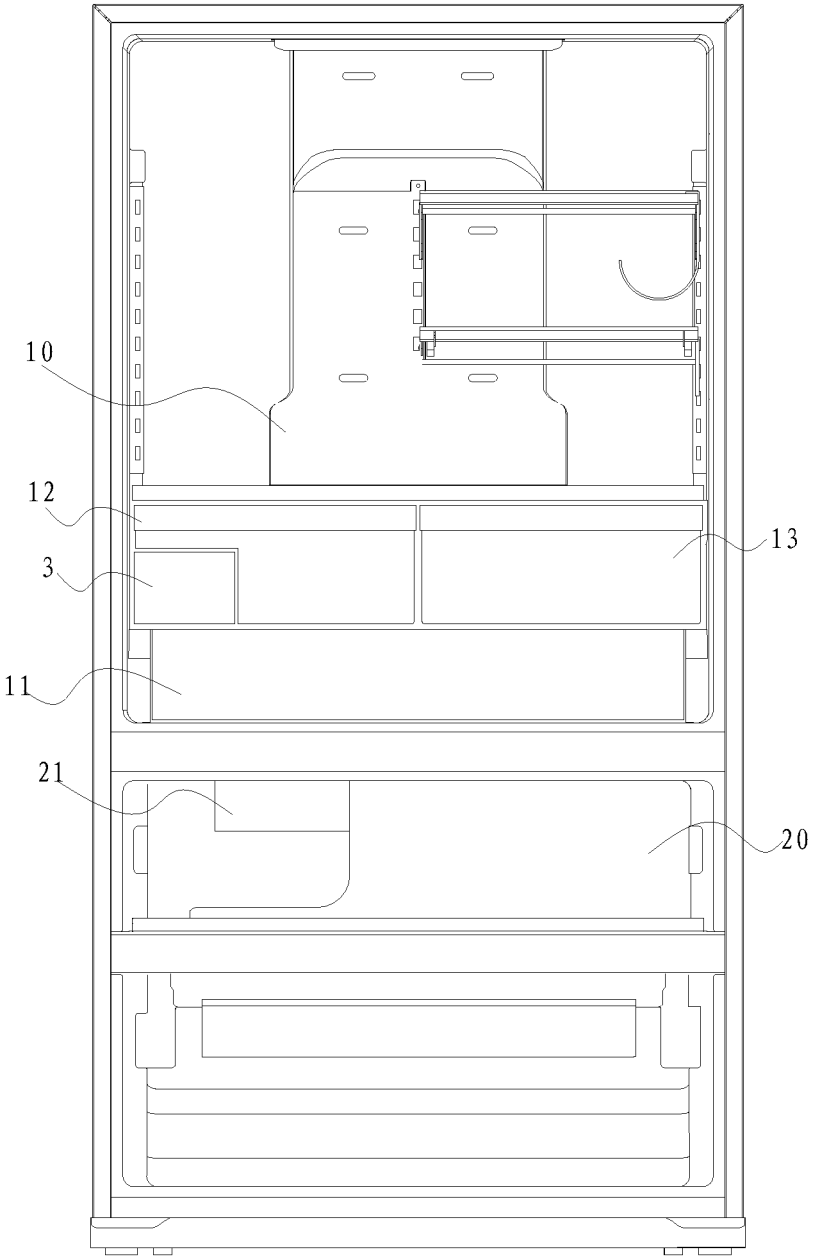
FIG. 4 is a schematic view of the refrigerator according to an embodiment of the present disclosure, in which the water tank is embedded in a recessed groove of the first container.

As shown in FIG. 4, in an example of the present disclosure, a recessed groove is formed at a side of a bottom of the first container 12, and the water tank 31 is embedded in the recessed groove. Alternatively, the first container 12 is a parallelepiped box and adapted to be embedded in the recessed groove. As shown in FIG. 4, generally, the ice making device 21 is disposed at the left side of the refrigerator, the first container 12 is disposed above the variable temperature drawer 11, the water tank 31 is disposed at a lower left corner of the first container 12 and embedded in the recessed groove, so that a distance between the water tank 31 and the ice making device 21 is shorter, thus facilitating connection between the water tank 31 and the ice making device 21. In some embodiments of the present disclosure, the second container 13 includes one or more parallelepiped boxes. Preferably, the second container 13 comprises one box disposed above the variable temperature drawer 11 and a width of the one box is same with that of the first container 12, namely, the first and second containers 12 and 13 are symmetrical to each other about a longitudinal center line of the refrigerating chamber 10.

Comparing to the conventional refrigerator, when the water tank 31 was not needed, the water tank 31 and the first container 12 may be removed from the refrigerating chamber 10 and substituted by a sealed container, storing box or other container having the same shape and size with the first container 12. Therefore, the storing space of the refrigerator according to the embodiment of the present disclosure can be sufficiently used.

In some embodiments of the present disclosure, as shown in FIG. 2, the water tank 31 includes a tank body 311, a cover 312 and a suction pipe 313. The cover 312 is used to cover a top opening of the tank body 311 in order to prevent dust or other contaminant from entering into the water tank 31. The suction pipe 313 defines a first end extending into a bottom of the tank body 311 and a second end. The water pump 32 comprises an inlet 321 connected to the second end of the suction pipe 313 and an outlet 322.

Meanwhile, the water pump 32 is disposed at the rear side of the water tank 31 and installed at an inner side of the refrigerator corresponding to the door of the refrigerator. The water pipe unit 33 comprises: a funnel 331, a connecting pipe 332 connected to a bottom of the funnel 331 and an injection pipe 333 connected to a bottom of the connecting pipe 332 and extended into the ice making device 21. The funnel 331 defines a first end and a second end, the first end of the funnel 331 is disposed below the inlet 321 and the position of the first end of the funnel 331 is corresponding to that of the inlet 321, so as to receive water from the inlet 321. The connecting pipe 332 defines a first end connected to the second end of the funnel 331 and a second end. The injection pipe 333 defines a first end connected to the second end of the connecting pipe 332 and a second end extended into the ice making device 21.

As shown in FIG. 2, in order to take out the water tank 31 from the refrigerator, the suction pipe 313 is detachably connected to the inlet 321. The outlet 322 of the water pump 32 is located above the funnel 331 and its position is corresponding to that of the funnel 331, so as to delivery the water from the water tank 31 pumped by the water pump 32 into the funnel 331, and then delivery the water into the ice making device 21 via the connecting pipe 332 and the injection pipe 333.

In some embodiments, the shape of the water tank 31 of the water supply device matches that of the first container 12 and/or the second container 13, and the water tank 31 is disposed above and close to the variable temperature drawer 11 disposed in of the refrigerating chamber 10, therefore, it is easy for the user to fill the water tank 31 with clean potable water. Comparing to the conventional refrigerator using the external water source or barreled water, the water for making ice in the embodiments of the present disclosure is guaranteed to be salutary and clean, so that the possible disadvantageous influence of the water on the food stored in the freezing chamber 20 is avoided, thus improving the preservation effect of the refrigerator. In additional, comparing to the conventional refrigerator in which the water tank is disposed on the thermal insulation layer, a temperature the variable temperature drawer 11 is in the range of about −3° C. to about 8° C., so that the water in the water tank 31 is hardly to be frozen, thereby the water can be continuously supplied to the ice making device 21, and the function of ice making and the freezing effect are ensured.

A thermal insulation layer 30 is disposed between the refrigerating chamber 10 and the freezing chamber 20, and a foaming agent is filled in the thermal insulation layer 30, the thermal insulation between the refrigerating chamber 10 and the freezing chamber 20 can be efficiently ensured by the foaming agent. Similar to the conventional design, through-holes are formed in a top of the thermal insulation layer 30 (an inner liner of the refrigerating chamber 10) and a bottom of the thermal insulation layer 30 (an inner liner of the freezing chamber 20) respectively. The first end of the injection pipe 333 is passed through the through-hole in the top of the thermal insulation layer 30 and extended into the refrigerating chamber 10 so as to connect to the second end of the connecting pipe 332, and the second end of injection pipe 333 is passed through the through-hole in the bottom of the thermal insulation layer 30 and extended into the freezing chamber 20, thus providing water for the ice making device 21.

In another embodiment of the present disclosure, the refrigerator further includes a fixing unit. The fixing unit is disposed in the thermal insulation layer 30 between the refrigerating chamber 10 and the freezing chamber 20 so as to fix the injection pipe 333 within the thermal insulation layer 30.

As shown in FIGS. 2 and 4, the injection pipe 333 is obliquely disposed within the thermal insulation layer 30, and further comprises a first connecting section 3331 and a second connecting section 3332. it should be understood that the first connecting section 3331 and the second connecting section 3332 described herein are different with the first end and second end of the injection pipe 333, the first end and second end of the injection pipe 333 mean two terminal ends of the injection pipe 333, however, the first connecting section 3331 means a length of the injection pipe 333 contacted to the thermal insulation layer 30 after fixing the injection pipe 333 to the bottom of the thermal insulation layer 30, and the second connecting section 3332 means a length of the injection pipe 333 contacted to the thermal insulation layer 30 after fixing the injection pipe 333 to the top of the thermal insulation layer 30.

The fixing unit includes a first fixing member 50 and a second fixing member 60. The first fixing member 50 fixes the first connecting section 3331 of the injection pipe 333 to the bottom of the thermal insulation layer 30. The second fixing member 60 supports the second connecting section 3332 of the injection pipe 333 between the bottom and the top of the thermal insulation layer 30.

Comparing to the conventional fixing manner in which the injection pipe 333 is adhered to the thermal insulation layer 30, the refrigerator according to embodiments of the present disclosure employs a special structure for fixing the two connecting sections 3331, 3332 of the injection pipe 333 in which the two ends of the injection pipe 333 are passed through the through holes in the top and bottom of the thermal insulation layer 30 respectively, therefore, the fixing of the injection pipe 333 is firm and the fit between the injection pipe 333 and the thermal insulation layer 30 is tight. When the foaming of the foaming agent is performed within the thermal insulation layer 30, the injection pipe 333 will not bear too much stress and not deform, so that the foam leaking caused by cracks appearing around the connection between the injection pipe 333 and the top as well as bottom of the thermal insulation layer 30 can be avoided, thus remarkably improving the of assembling quality of the injection pipe 333 and the structure reliability of water supply device 3.

Figure 5:
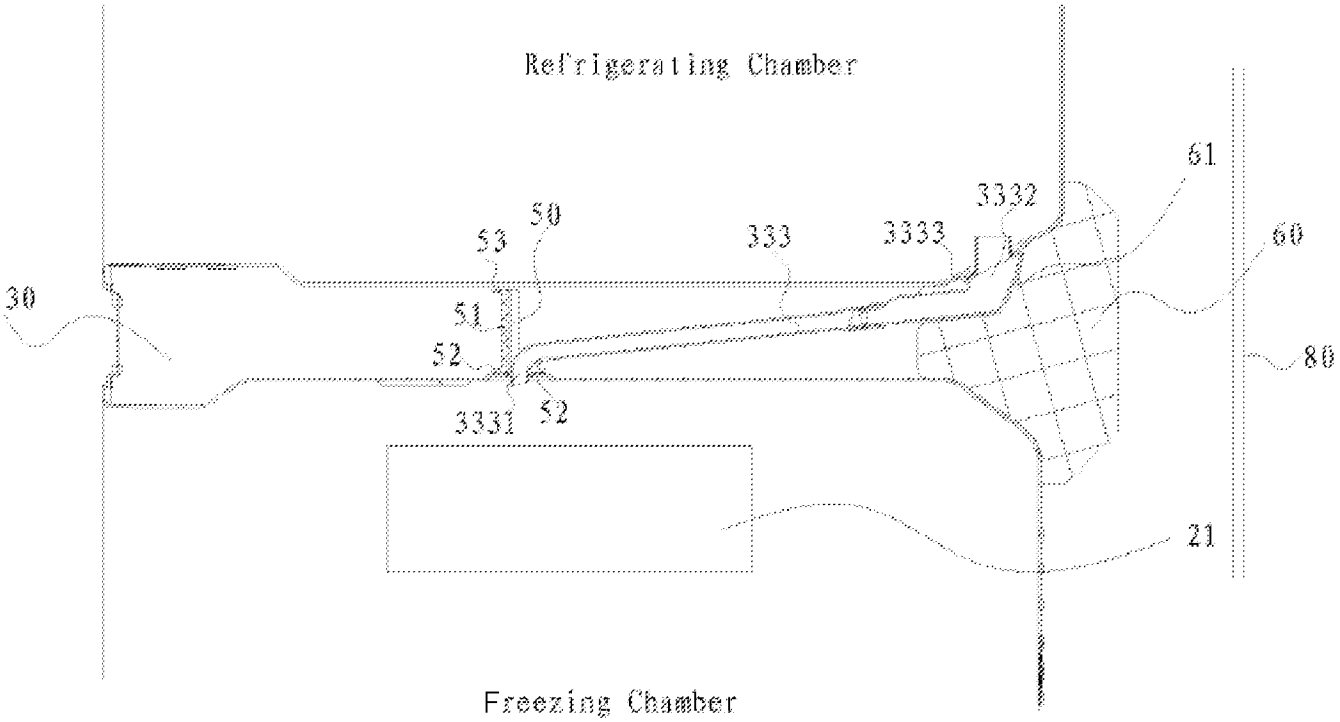
FIG. 5 is a schematic view of an injection pipe of the refrigerator fixed within a thermal insulation layer.
Figure 7:
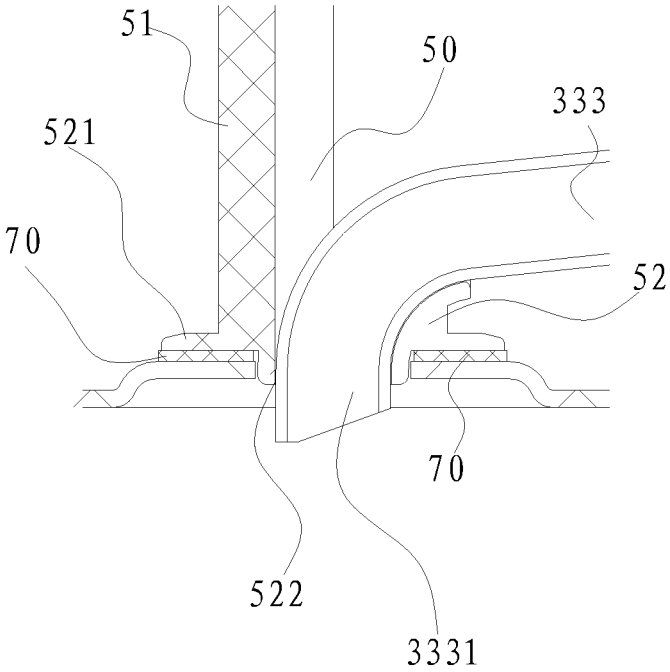
FIG. 7 is a schematic view of an injection pipe of the refrigerator connected to a bottom of the thermal insulation layer.

As shown in FIGS. 5 and 7, the first fixing member 50 comprises a fixing end 52, a supporting end 53 and a supporting column 51 connected between the fixing end 52 and the supporting end 53. The fixing end 52 is secured to the bottom of the thermal insulation layer 30 and has a connection hole 522 in which the first connecting section 3331 of the injection pipe 333 is fitted. Moreover, the fixing end 52 has a flange 521. The flange 521 is fixed to the bottom of the thermal insulation layer 30 and extended outwardly in a radial direction from the bottom of the supporting column 51. Alternatively, the flange 521 is adhered to the bottom of the thermal insulation layer 30 by a double-sided adhesive sponge.

The positions of the supporting end 53 and the fixing end 51 are corresponded to each other in the up and down direction and spaced apart from the top of the thermal insulation layer 30 by a space, and the supporting end 53 may have a similar structure to that of the flange 521. Therefore, the installation of the first fixing member 50 is convenient, and the supporting end 53 can provide supporting force for the inner liner of the refrigerator chamber 10, so that the inner liner of the refrigerator chamber 10 is prevented from deform greatly. The supporting column 51 is connected between the fixing end 52 and the supporting end 53 and can be shaped according to requirements. In one embodiment according to the present disclosure, the supporting column 51 is formed as a semi-tubular member having a predetermined wall thickness so as to adapt to the first connecting section 3331 of the injection pipe 333. Alternatively, the first fixing member 50 is integrally formed.

Figure 6:
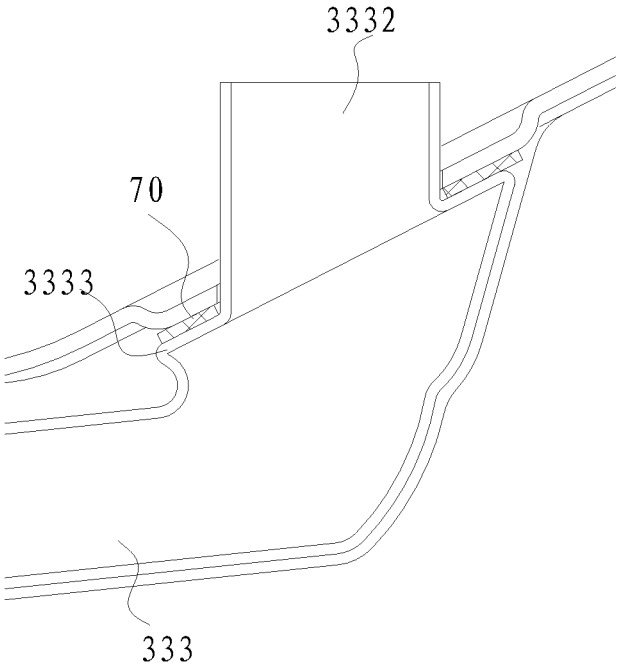
FIG. 6 is a schematic view of an injection pipe of the refrigerator connected to a top of the thermal insulation layer.

As shown in FIG. 5, a recess 61 is formed in the top of the second fixing member 60, and the second connecting section 3332 of the injection pipe 333 is received and supported in the recess. Alternatively, the position of the recess 61 is close to a rear wall 80 of the refrigerator. In one embodiment of the present disclosure, as shown in FIG. 6, the second connecting section 3332 is formed with a boss 3333. The boss 3333 is secured to a lower surface of the top of the thermal insulation layer 30. Alternatively, the boss 3333 is secured to the top of the thermal insulation layer 30 by a double-sided adhesive sponge. In another embodiment of the present disclosure, the second fixing member 60 is made of a material such as foam having elasticity and thermal insulation property.

A fixing process of the injection pipe 333 of the refrigerator will be described below with reference to FIGS. 1, 2 and 5-6.

Firstly, the first end of the injection pipe 333 is inserted into the connecting hole 522 such that the injection pipe 333 and the first fixing member 50 are formed as an assembly. Next, the injection pipe 333 is extended into the through-hole formed in the bottom of the thermal insulation layer 30, and a lower surface of flange 521 is adhered to the bottom of the thermal insulation layer 30 by the double-sided adhesive sponge 70, such that the flange 521 is located around the through-hole, that is, the assembly is mounted to the bottom of the thermal insulation layer 30. Therefore, the mounting is firm and the sealing between the injection pipe 333 and bottom of the thermal insulation layer 30 is good.

Secondly, after the first connecting section of the injection pipe is fixed to the bottom of the thermal insulation layer 30, the first end of the injection pipe 333 is inserted into and passed through the through-hole formed in top of the thermal insulation layer 30 and connected to the water tank 11. The second fixing member 60 is inserted between the top and bottom of the thermal insulation layer 30, and the recess 61 receives the second connecting section tightly so as to support the injection pipe 333 within the thermal insulation layer 30.

In the assembling process of the refrigerator according to the embodiments of the present disclosure, after mounting the injection pipe to the thermal insulation layer, the foaming agent is filled into the thermal insulation layer. Because the injection pipe is fixed by the fixing unit to the top and bottom of the thermal insulation layer, during the foaming process, the injection pipe is not easily to deform, in addition, no looseness occurred between the injection pipe and the top as well as bottom of the thermal insulation layer, thus avoiding foam leakage and improving the quality of the mounting process of the injection pipe and the structure reliability of the water supply device.

Reference throughout this specification to "an embodiment," "some embodiments," "one embodiment", "another example," "an example," "a specific examples," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example", "in an example," "in a specific examples," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments can not be construed to limit the present disclosure, and changes, alternatives, and modifications can be made in the embodiments without departing from spirit, principles and scope of the present disclosure.

What is claimed is:

1. A refrigerator, comprising:

a cabinet defining a refrigerating chamber and a freezing chamber therein, in which a variable temperature drawer is disposed in a lower part of the refrigerating chamber;

a thermal layer defined between an inner liner of the refrigerating chamber and an inner liner of the freezing chamber, a foaming agent being inserted within the thermal layer, between the inner liners of the refrigerating chamber and the freezing chamber;

an ice making device disposed in the freezing chamber, and a water supply device configured to supply water to the ice making device and including:

a water tank disposed above the variable temperature drawer;

a water pump connected to the water tank and having an inlet and an outlet;

a water pipe unit connected to the water tank and the ice making device respectively to deliver water from the water tank into the ice making device, and comprising:

a funnel defining a first end disposed below the outlet for receiving water from the outlet and a second end;

a connecting pipe defining a first end connected to the second end of the funnel and a second end; and an injection pipe extending through the insulating layer and defining a first end connected to the second end of the connecting pipe and a second end extended into the ice making device, wherein the injection pipe further comprises a first connecting section and a second connecting section; and a fixing unit disposed in the thermal insulation layer between the refrigerating chamber and the freezing chamber and configured to fix the injection pipe within the thermal insulation layer, wherein the fixing unit comprises:

a first fixing member extending between the inner liner of the refrigerating chamber and the inner liner of the freezing chamber and comprising a support end for supporting the inner liner of the refrigerating chamber and a fixing end with a flange secured to the inner liner of the freezing chamber, the fixing end having a connection hole through which the first connecting section of the injection pipe is fitted, which fixes the first connecting section of the injection pipe to the inner liner of the freezing chamber; and a second fixing member extending between the inner liner of the refrigerating chamber and the inner liner of the freezing chamber, the second fixing member supporting the second connecting section of the injection pipe in the thermal insulation layer, between the inner liner of the refrigerating chamber and the inner liner of the freezing chamber.

2. The refrigerator as set forth in claim 1, further comprising first and second containers for storing fruit and/or vegetables disposed above the variable temperature drawer, respectively.

3. The refrigerator as set forth in claim 2, wherein the first and second containers are disposed at two sides of the water tank in a transverse direction respectively.

4. The refrigerator as set forth in claim 3, wherein the first and second containers have a same shape and size and are symmetrical about the water tank.

5. The refrigerator as set forth in claim 2, wherein the first container is a parallelepiped box, a recessed groove is formed at a side of a bottom of the first container, and the water tank is embedded in the recessed groove.

6. The refrigerator as set forth in claim 5, wherein the first and second containers are symmetrical about a longitudinal center line of the refrigerating chamber.

7. The refrigerator as set forth in claim 1, wherein the water pump is disposed at a rear side of the water tank and detachably connected to the water tank.

8. The refrigerator as set forth in claim 1, wherein the water tank comprises:

a tank body;

a cover covering a top opening of the tank body; and a suction pipe defining a first end extending to a bottom of the tank body and a second end connected to the inlet of the water pump.

9. The refrigerator as set forth in claim 1, wherein the first fixing member further comprises:

a supporting column between the fixing end and the supporting end, and wherein the supporting end is spaced apart from the top of the inner liner of the refrigerating chamber by a space.

10. The refrigerator as set forth in claim 9, wherein the supporting column has a predetermined wall thickness so as to adapt to the first connecting section of the injection pipe.

11. The refrigerator as set forth in claim 9, wherein the first fixing member is integrally formed.

12. The refrigerator as set forth in claim 1, wherein the flange is fixed to the inner liner of the freezing chamber using a double-sided adhesive sponge.

13. The refrigerator as set forth in claim 1, wherein a recess is formed at a top of the second fixing member, and the second connecting section of the injection pipe is received and supported in the recess;

wherein the second connecting section is formed with a boss secured to a lower surface of the inner liner of the refrigerator chamber.

14. The refrigerator as set forth in claim 13, wherein the second fixing member is made of foam.

15. The refrigerator as set forth in claim 13, wherein the boss is secured to the top of the thermal insulation layer using a double-sided adhesive sponge.

* * * * *